US009023412B2

(12) United States Patent
Doleac et al.

(10) Patent No.: US 9,023,412 B2
(45) Date of Patent: May 5, 2015

(54) CAPSULE FOR PREPARATION OF A FOOD PRODUCT FROM A FOOD PREPARATION MACHINE

(75) Inventors: Frederic Doleac, Vaux et Chantegrue (FR); Marc Raederer, Morrens (CH)

(73) Assignee: Nestec S.A., Vevey (CH)

( * ) Notice: Subject to any disclaimer, the term of this patent is extended or adjusted under 35 U.S.C. 154(b) by 383 days.

(21) Appl. No.: 13/808,785

(22) PCT Filed: Oct. 25, 2010

(86) PCT No.: PCT/EP2010/066067

§ 371 (c)(1),
(2), (4) Date: Jan. 7, 2013

(87) PCT Pub. No.: WO2012/003891

PCT Pub. Date: Jan. 12, 2012

(65) Prior Publication Data

US 2013/0115340 A1 May 9, 2013

(30) Foreign Application Priority Data

Jul. 7, 2010 (EP) ..... 10168664

(51) Int. Cl.
*B65D 85/804* (2006.01)

(52) U.S. Cl.
CPC ..... *B65D 85/8043* (2013.01)

(58) Field of Classification Search
CPC ..... B65D 85/8043
See application file for complete search history.

(56) References Cited

U.S. PATENT DOCUMENTS

| | | | |
|---|---|---|---|
| 8,307,754 | B2 | 11/2012 | Ternite et al. |
| 2006/0107841 | A1 | 5/2006 | Schifferle |
| 2007/0144355 | A1 | 6/2007 | Denisart et al. |

FOREIGN PATENT DOCUMENTS

| | | | |
|---|---|---|---|
| CN | 201160776 | | 12/2008 |
| DE | 102004056224 | A1 | 5/2006 |
| DE | 102004056317 | A1 | 5/2006 |
| EP | 1967069 | A1 | 9/2008 |

OTHER PUBLICATIONS

International Search Report and Written Opinion issued Feb. 7, 2011 for Intl. Appln. No. PCT/EP2010/066067.

*Primary Examiner* — Rena L Dye
*Assistant Examiner* — Chaim Smith
(74) *Attorney, Agent, or Firm* — K&L Gates LLP

(57) ABSTRACT

The present invention is directed to a capsule (1) for use with a capsule holder (6) of a food preparation machine, wherein: —said machine comprises a needle (9) supported by a plate, for injection of a jet of fluid inside the capsule, said needle being adapted in shape and size to protrude inside the capsule when said capsule holder is inserted into the machine in order for operation, and said capsule comprises a body with side (2), bottom (4) and top walls (3), said capsule further comprising a top circumferential edge (8), the interface between the needle plate, the capsule holder, and the capsule edge being leaktight, said top wall being sealed onto said circumferential edges and comprises built-in showering means (10) comprising at least one opening, so as to accommodate the needle without piercing and transform the jet of fluid from said needle into at least one jet directed towards the inside of the capsule chamber.

5 Claims, 4 Drawing Sheets

CAPSULE FOR PREPARATION OF A FOOD PRODUCT FROM A FOOD PREPARATION MACHINE

CROSS REFERENCE TO RELATED APPLICATIONS

The present application is a National Stage of International Application No. PCT/EP2010/066067, filed on Oct. 25, 2010, which claims priority to European Patent Application No. 10168664.0, filed Jul. 7, 2010, the entire contents of which are being incorporated herein by reference.

FIELD OF THE INVENTION

The present invention concerns a capsule for use with a food preparation machine by extraction and/or dissolution of a food ingredient contained therein.

BACKGROUND OF THE INVENTION

Machines for preparing a beverage or other types of food product by injecting pressurized fluid into a capsule are well-known, especially in the field of producing coffee or coffee type beverages. In addition, other substances such as chocolate or milk products can be extracted or dissolved to form a beverage, as well as other types of nutritional products such as infant nutrition products. The advantages of such a system are in particular the conservation and freshness of the ingredients, as well as the possibility of facilitating the operations of preparing the beverage.

The method of preparing the beverages using such a machine is in principle as follows. The capsule is usually first inserted into a receiving chamber of the beverage preparation machine. After that, a water injecting means, such as a needle connected to the liquid supply of the machine and which projects inside the receiving chamber, is introduced through a wall, typically a top wall, of the capsule to inject a hot or cold liquid, in order to make the liquid interact with the ingredients within the capsule. The food product, typically a liquid beverage, resulting from this interaction is then discharged through a delivery, typically a bottom wall of the capsule. For example, the delivery wall opens due to the internal pressure in the capsule generated by injecting the liquid.

DE102004056317 is a German patent application to Rene Schifferle. It discloses a beverage machine for the preparation of a hot beverage by extraction of an ingredient contained in a capsule. The machine comprises an extraction chamber and a closure member for closing the chamber. The lower cup-shaped side of the extraction chamber serves as a positive receptacle for the capsule. Each of the lower side of the extraction chamber and the closure member comprises an injection element which is arranged for reciprocal perforation of the capsule.

When the extraction chamber is closed and locked, both ends of the capsule are perforated by an injection element. The capsule comprises top and bottom inner filtering means spaced apart respectively from the capsule top and bottom walls being pierced by the injection elements. The inner filtering means allow the circulation of extraction fluid through the ingredient, without said ingredient being moved throughout the capsule.

The extraction fluid is usually injected inside the capsule under pressure. In some instances, when the consumer removes the capsule, the fluid remaining inside the capsule can be forced back outside through the capsule top wall, which is called "backflow". Such a phenomenon is highly undesirable since the consumer may be hurt if spilled with hot water from the capsule. It was found that such a phenomenon is particularly frequent when the capsule comprises compartmented spaces therein.

DE102004056224 is a German patent application to Tchibo GmbH. It discloses a coffee machine for brewing a hot drink, in particular, a coffee drink, by means of a portion capsule with a capsule lid and a capsule base, comprising a pressurised water device, a portion capsule holder and a controller. The portion capsule holder is provided with two relatively-displaceable puncture means, which pierce the capsule lid and the capsule base on or after insertion of the portion capsule in the portion capsule holder, such that hot water can enter the portion capsule through the capsule lid and the drink escapes through the capsule base from the portion capsule. The controller is provided for the provision of three differing pressures for the pressurised water, for example, for brewing espresso, white coffee and filter coffee. The capsule base of the portion capsule can comprise a pre-weakened spot.

It should be understood that the interaction between the liquid and the ingredients within the capsule can be e.g. dissolving, extraction, brewing or any other interaction in order to prepare a beverage by means of ingredients provided within the capsule.

Furthermore, once the injection needle has pierced a wall of the capsule and injection of fluid has begun, the distal end of the needle which protrudes inside the capsule chamber is in contact with the product being prepared therein. After the product preparation is completed and needle has been removed from the capsule, food product can remain on the surface of the said needle, and cross contaminate a product preparation which would occur afterwards. In some cases when the machine is not used for a long time, bacterial growth may occur in the distal portion of the needle which was in contact with product, which is of course highly undesirable to the consumer.

It is therefore a main objective of the present invention to provide a capsule for preparing a food product using a food preparation machine that is convenient to use for consumer, that provides good dissolution and/or extraction properties of the ingredients contained therein, and which avoids backflow and contamination of the fluid injection needle of the machine.

SUMMARY OF THE INVENTION

The present invention meets the objective cited above with a capsule for use with a capsule holder of a food preparation machine, wherein:

said machine comprises a fluid injection needle supported by an injection plate, for injection of a single jet of fluid inside the capsule, said needle being adapted in shape and size to protrude inside the capsule when said capsule holder is inserted into the machine in order for operation, and said capsule comprises a body with side, bottom and top walls defining a chamber wherein a food ingredient is contained which is to be extracted and/or dissolved by the fluid injected in said chamber through said top wall, said capsule further comprising a top circumferential edge such that when said capsule is loaded in the capsule holder and said capsule holder is placed in the machine in order for operation, the interface between the needle plate, the capsule holder, and the capsule edge is leak-tight so that fluid can flow from the injection means only through said capsule, and the capsule top wall is sealed onto said circumferential edges, characterized in that the capsule top wall comprises built-in showering means comprising at least one opening so as to accommodate the needle without piercing of said showering means, and transform the single jet of fluid from said needle into at least one jet directed towards the inside of the capsule chamber.

The fact that the showering means is built-in with the capsule top wall makes the capsule particularly easy and cheap to manufacture: there is no need for additional parts to be manufactured separately and then assembled with the top membrane, or inside the capsule.

Advantageously, the showering means comprises a plurality of showering holes having each a diameter which is inferior to the output diameter of the needle.

In any case, the diameter of the showering hole(s) is preferably less than the diameter of the needle outlet opening, and the speed of the jet of fluid through the top wall inside the chamber has a reduced speed compared to the speed of the jet coming out of the needle.

In a first embodiment of the present invention, the top wall is rigid and the showering means comprise a built-in portion protruding downwards inside the capsule chamber.

Preferably in that case, the top wall is pivotally attached to the capsule side walls via a pivot hinge.

In a second possible embodiment of the present invention, the top wall is a flexible film sealed onto the circumferential edges of the capsule body, said top wall comprising at least one layer of a pre-pierced film that is flexible enough to deform without piercing when in contact with the injection needle.

BRIEF DESCRIPTION OF THE DRAWINGS

Additional features and advantages of the present invention are described in, and will be apparent from, the description of the presently preferred embodiments which are set out below with reference to the drawings in which.

DETAILED DESCRIPTION OF THE INVENTION

Figure 1:
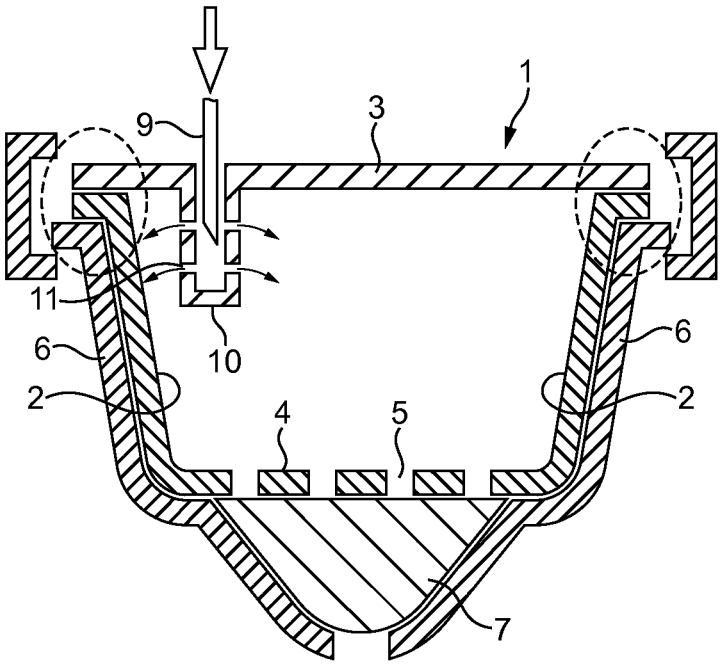
FIG. 1 is a schematic profile cut view of a first embodiment of a capsule according to the invention, used with a cup-shaped capsule holder.

In the following detailed description, the example given is that of a machine—not represented in the drawing—with capsules for preparing beverages, typically coffee. Said machine comprises a fluid injection needle supported by an injection plate, for injection of a single jet of fluid inside the capsule, said needle being adapted in shape and size to protrude inside the capsule when said capsule holder is inserted into the machine in order for operation. Such a machine was described for instance in prior European patent EP 1967069 B1. According to the invention, the outer surface of the capsule top wall is in contact, at least partially, with the needle plate of the machine, during the dissolution/extraction step.

FIG. 1 shows a first embodiment of a capsule 1 according to the invention, wherein the capsule body is cup-shaped, with side walls 2, a top wall 3, and a bottom wall 4 that is pierced with a plurality of dispensing holes 5 for the product produced inside the capsule chamber to flow out. The capsule top wall 3 is rigid, the outer surface of the rigid top wall is covered during storage by a removable lid, which can be a glued or sealed foil, or a semi-rigid lid clipped thereonto—not shown on the drawing—.

The capsule 1 is placed in a capsule holder 6, to which a supporting insert 7 can be added in order to support the bottom wall 4 of the capsule. Such an insert 7 can be necessary to prevent damage to the capsule wall, particularly when the capsule contains such products like roast and ground powdered coffee, which requires high fluid pressure inside the capsule chamber to prepare the final product, for instance espresso coffee. In this case, if the capsule that is loaded into the capsule holder does not fit properly the internal shape and size of the capsule holder, when fluid pressure inside the capsule holder increases, the portion of the capsule wall that is not supported by the capsule holder walls can be pushed outwardly, and even can be pierced, which is of course highly undesirable.

The insert 7 also has another important effect: in the case shown in FIG. 1, the said insert 7 counterbalances the flow of product that flushes out of the capsule dispensing holes 5. By doing this, the insert 7 contributes to keeping a high pressure inside the capsule chamber, while allowing the product by high pressure extraction to flow out.

Such an insert is not necessary in case the ingredient contained inside the capsule is meant to be dissolved or brewed at a low pressure, for instance in the case of soluble milk, tea, soup, soluble coffee, or roast and ground powdered coffee beans to be brewed at low pressure to produce "filter coffee"-like product.

As illustrated in FIG. 1, the capsule 1 comprises a top circumferential edge 8 disposed at the upper portion of the side walls 2, such that when said capsule is loaded in the capsule holder 6 and said capsule holder is placed in the machine in order for operation, the interface between the needle plate, the capsule holder 6, and the capsule edge 8 is leaktight so that fluid injected through the needle 9 can flow only through said capsule. More precisely, the top wall 3 is sealed onto said circumferential edges 8.

As illustrated in FIG. 1, the top wall 3 comprises built-in showering means. The showering means 10 is a portion protruding downwards inside the capsule chamber that is built-in with the rigid top wall 3, which comprises a plurality of showering holes having each a diameter which is inferior to the output diameter of the fluid injection needle 9. The showering means 10 is able to accommodate the needle 9 without being pierced by said needle, and it transforms the single jet of fluid from said needle 9 into a plurality of jets—indicated with arrows in the drawing—directed towards the inside of the capsule chamber.

The top wall 3 can be made of any suitable material such as coated cardboard, metal, plastic, rigid laminated film, or a combination thereof, but preferably, it is made by injection of a thermoplastic such as polyethylene or polypropylene.

Figure 2:
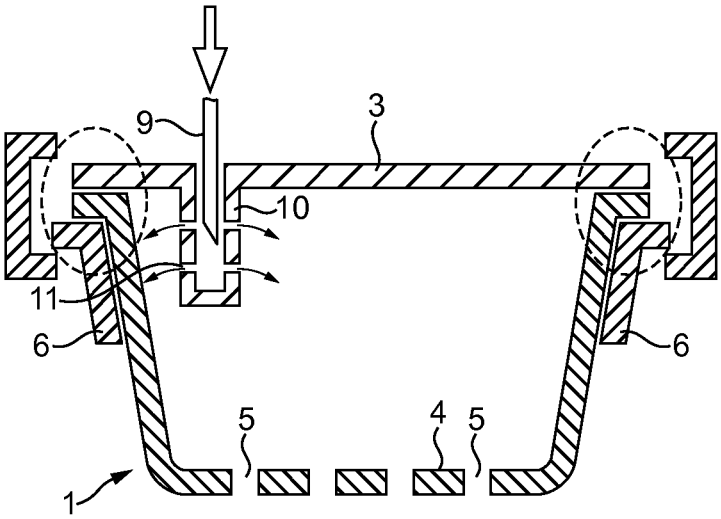
FIG. 2 is a schematic view similar to FIG. 1, wherein the capsule is used with a ring shaped capsule holder.

FIG. 2 shows a variant of the embodiment described above in reference to FIG. 1. In this case, the capsule 1 is supported by a ring-shaped capsule holder 6. As described above, the interface between the needle plate, the capsule holder 6, and the capsule edge 8 is leaktight so that fluid injected through the needle 9 can flow only through said capsule.

In this case, it can be seen that no insert supports the bottom wall 4 of the capsule 1, nor does an insert support the side walls 2. Along with the explanations given above, the capsule shown in FIG. 2 is therefore meant for a low pressure preparation of a food product.

Figure 3:
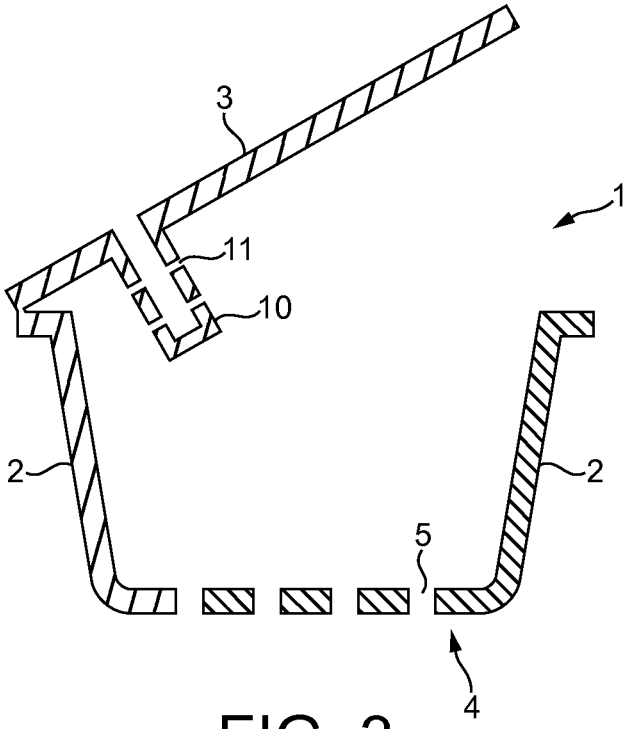
FIG. 3 is a schematic profile cut view of an alternative construction of the first embodiment of the invention illustrated in FIGS. 1 and 2.

Turning now to FIG. 3, one can see another variant of the embodiment described above in reference to FIGS. 1 and 2. In this case, the top wall 3 is pivotally attached to the capsule side walls 2 via a pivot hinge 12. More precisely, the hinge is disposed between the top wall 3 and the circumferential edge 8. In this case, the capsule bottom wall 4, side walls 2, the hinge 12, and the top wall 3 are manufactured as a single piece by injection molding of a thermoplastic material.

Figure 4:
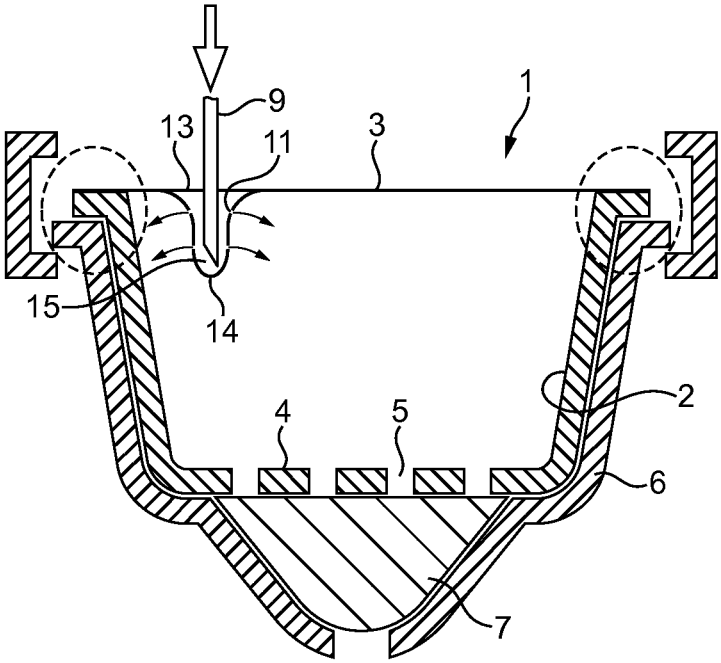
FIG. 4 is a schematic profile cut view of a second embodiment of a capsule according to the invention, used with a cup-shaped capsule holder.
Figure 5:
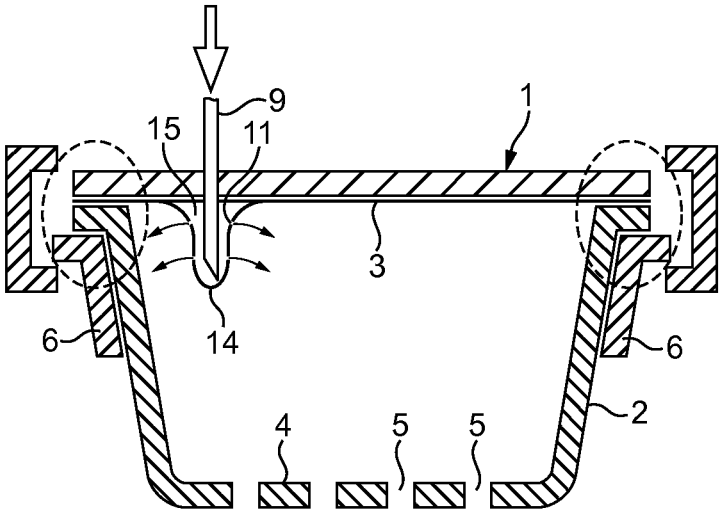
FIG. 5 is a schematic view similar to FIG. 3, wherein the capsule is used with a ring shaped capsule holder.

FIG. 4 shows a second embodiment of the invention, wherein the top wall 3 of the capsule 1 is a flexible film. The said film 3 is a multilayer film comprising on the outside a continuous, pierceable layer 13, and the inner layer 14 comprises a deformable layer that is pierced with a plurality of showering holes 11. When the needle 9 presses onto the capsule top wall 3, the first layer 13 of the top wall 3 is pierced by the needle which passes through and contacts the bottom deformable layer 14. Both layers 13, 14 of the top wall delaminate as illustrated in FIG. 4 or 5, such that the deformable layer 14 accommodates the needle shape and size without being pierced through. When fluid is injected through the needle, the fluid occupies the space 15 comprised between the two layers 13, 14, and flows through the showering holes 11 of the deformable layer 14.

At that time, the fluid shower jets that are created inside the capsule have a reduced speed compared to the speed of the fluid jet initially coming out of the needle.

FIG. 5 shows a variant of the embodiment described above in reference to FIG. 4. In this case, the capsule 1 is supported by a ring-shaped capsule holder 6. As described above, the interface between the needle plate, the capsule holder 6, and the capsule edge 8 is leaktight so that fluid injected through the needle 9 can flow only through said capsule.

In this case, it can be seen that no insert supports the bottom wall 4 of the capsule 1, nor does an insert support the side walls 2. Along with the explanations given above, the capsule shown in FIG. 5 is therefore meant for a low pressure preparation of a food product.

Figure 6:
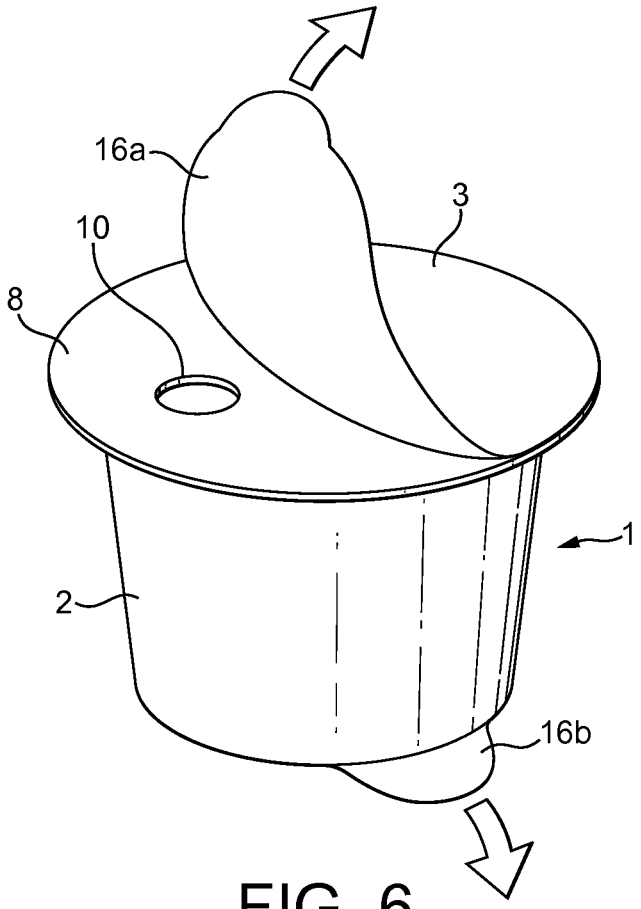
FIG. 6 is a schematic perspective view of a capsule with peelable closing membranes.

As illustrated in FIG. 6, the capsule according to the present invention can be manufactured so that the top wall 3, including the showering means 10, is covered with a peelable film layer 16*a* sealed onto the circumferential edges 8 of the capsule body. Similarly, the bottom wall 4 can be covered by a peelable film layer 16*b*, which is sealed onto the circumferential edge of the said bottom wall. Such peelable layers 16*a*, 16*b*, avoid the need for a secondary packaging enveloping the whole capsule to keep the product freshness during storage, when the top and/or bottom walls of the capsule are prepierced with inlet, respectively outlet openings as illustrated in FIG. 1, 2, or 3.

Figure 7:
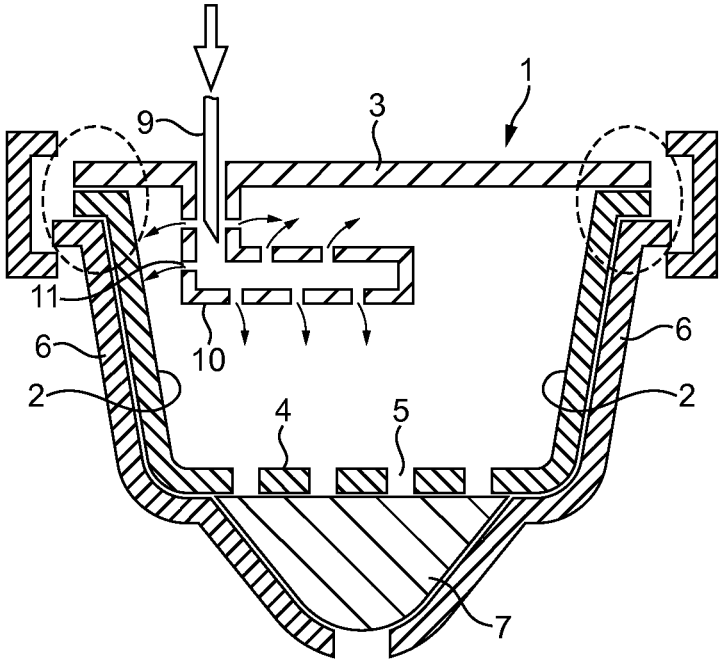
FIG. 7 is yet a schematic cut view of another embodiment of the invention.

FIG. 7 illustrates yet another embodiment of the invention, which is a variant of the embodiment described above with reference to FIG. 1. In the present case, the showering protrusion 10 protrudes downwards into the capsule chamber, but its shape is angled so that its distal end extends horizontally across the internal cross-section of the capsule chamber. As can be seen from FIG. 7, the fluid flow output—marked in the drawing with a series of small arrows—is therefore more even throughout the capsule chamber. Different shapes for the distal end of the showering means protrusion 10 could be envisaged, following the principle of an even distribution of the fluid flow path.

In all embodiments and variants described herein above, the interface between the portion of the needle plate that carries the needle 9, and the top wall 3 of the capsule 1, is preferably leaktight. In this case, the portion of the needle plate surrounding the needle has preferably a shape as described for instance in prior European patent EP 1967099 B1, so as to create a leak-tightness at least locally around the injection point between the needle 9 and the top wall 3.

Alternatively to the leak-tightness achieved locally around the injection point, the sealing can be realised at the interface between the capsule holder upper edge, the capsule circumferential edge 8, and the surroundings of the needle plate 17, as illustrated by dotted-line circles in FIG. 5.

In order to guarantee the freshness of the ingredient contained therein, the capsule must be closed during storage, and open only at the time it is used with machine. In a first possibility the capsule itself is open at the top and/or the bottom sides, as represented in FIGS. 1 to 5. The tightness during storage is guaranteed by a secondary packaging such as a flowpack—not shown in the drawing.

Alternatively, the capsule itself is preferably closed, so as to avoid the need for a secondary packaging while guaranteeing the freshness of the product contained inside during long storage periods. In this case, as illustrated in FIG. 6, the capsule open walls, can be covered with peelable film membrane, which are preferably made of a material barrier to gas and light. The peelable film membranes can be heat sealed, ultrasonically sealed, glued or attached by any other means which provide a tight sealing while allowing a consumer to easily peel them off. In an alternative embodiment—not shown in the drawing—, the peelable film membranes are replaced by rigid or flexible lids which are clipped to the capsule walls.

The capsule according to the present invention is suitable for high or low pressure extraction of the ingredient(s) contained therein. In case the contents is coffee, the capsule of the invention can be used for high pressure extraction of roast and ground powdered coffee beans, or for low pressure dissolution of soluble powdered coffee. The conception of the capsule, independent from the essential features disclosed and claimed in the present patent specification, can be adapted according to the necessary features for high or low pressure use, which the skilled person will be able to choose appropriately. If needed, an insert as described above can be used to guarantee that a high pressure inside the capsule will not damage it.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

The invention claimed is:

1. A capsule for use with a food preparation machine, wherein:

the machine comprises a fluid injection needle supported by an injection plate, for injection of a single jet of fluid inside the capsule, the needle being adapted in shape and size to protrude inside the capsule when the capsule is inserted into the machine in order for operation;

the capsule comprises a body with side, bottom and top walls defining a chamber wherein a food ingredient is contained which is to be extracted and/or dissolved by the fluid injected in the chamber through the top wall, the capsule further comprising a top circumferential edge such that when the capsule is placed in the machine in order for operation, the interface between the needle plate, and the capsule edge is leaktight so that fluid can flow from the injection needle only through the capsule;

the capsule top wall is sealed onto the circumferential edge; and the capsule top wall comprises a built-in showering member comprising at least one opening so as to accommodate the needle without piercing of the showering member, and transform the single jet of fluid from the needle into at least one jet directed towards the inside of the capsule chamber.

2. A capsule according to claim 1, wherein the showering member comprises a plurality of showering holes each having a diameter which is less than an output diameter of the needle.

3. A capsule according to claim 1, wherein the top wall is rigid and the showering member comprises a built-in portion protruding downwards inside the capsule chamber.

4. A capsule according to claim 3, wherein the top wall is pivotally attached to the capsule side walls via a pivot hinge.

5. A capsule according to claim 1, wherein the top wall is a flexible film sealed onto the circumferential edges of the capsule body, the top wall comprising at least one layer of a pre-pierced film that is flexible enough to deform without piercing when in contact with the injection needle.

* * * * *